United States Patent [19]

Jones

[11] 4,371,053

[45] Feb. 1, 1983

[54] PERFORATE TUBE MUFFLER

[75] Inventor: Adrian D. Jones, Edwardstown, Australia

[73] Assignee: Hills Industrie Limited, Edwardstown, Australia

[21] Appl. No.: 242,935

[22] Filed: Mar. 12, 1981

[30] Foreign Application Priority Data

Mar. 17, 1980 [AU] Australia ..... PE2781

[51] Int. Cl.[3] ..... F01N 1/02

[52] U.S. Cl. ..... 181/249; 181/269

[58] Field of Search ..... 181/248–251, 181/269

[56] References Cited

U.S. PATENT DOCUMENTS

| | | | |
|---|---|---|---|
| 1,611,475 | 12/1926 | Maxim | 181/249 |
| 1,811,762 | 6/1931 | Schnell | 181/248 |
| 1,909,394 | 5/1933 | Dodge | 181/249 |
| 2,512,155 | 6/1950 | Hill | 181/249 |
| 3,754,619 | 8/1973 | McCormick | 181/248 |

*Primary Examiner*—Benjamin R. Fuller

*Attorney, Agent, or Firm*—Norbert P. Holler; Charles A. Blank

[57] ABSTRACT

A muffler of the Helmholtz resonator type has a housing surrounding a main gas flow conduit, the gas flow conduit having an apertured zone within the housing wherein apertures extend through the conduit wall, the shape of the conduit wall at the apertured zone being so varied that gas flows through the apertures into or out of the housing, the flow inhibiting the development of whistle noises.

1 Claim, 6 Drawing Figures

PERFORATE TUBE MUFFLER

This invention relates to a muffler which is suitable for use on a motor vehicle although it may also be used in other applications of silencing a fluid flow, for example water lines or air conditioning ducts. It also relates to a muffler of the type having a perforate tube which extends through an otherwise sealed chamber, thereby constituting a Helmholtz resonator.

BACKGROUND OF THE INVENTION

It is common practice to use perforate or slotted tubes in Helmholtz resonator mufflers, as well as in some sections of more complex mufflers, but owing to the tendency for a perforation or slot to cause whistling (noises at about 1000 Hz or more), it has heretofore usually been deemed necessary to have louvres formed in the tubes. This causes secondary difficulties however, in that the louvres are formed outwardly or inwardly or both by lancing and stretching small areas of the tube wall. This operation is usually achieved in a press, the tube either being formed by firstly lancing and subsequent rolling the workpiece, or forming a tube in imperforate form and subsequently lancing the louvres in the tube wall. In the first case the resultant tube has a bead joining its edges, and is usually non-circular and quite unsuitable for accurate fitting to the skirts on the ends of a muffler housing or accurate fitting to a properly rounded tube. Furthermore, in both cases, outstanding louvre edges prevent the tube from being driven through a preformed muffler housing or preformed internal baffle, and inwardly facing louvre edges prevent a close-fitting tube being placed inside the louvred tube.

The main object of this invention is to provide improvements whereby a perforate or slotted tube can be employed, without the need for louvres.

BRIEF SUMMARY OF THE INVENTION

In this invention a muffler of the Helmholtz resonator type has a housing surrounding a main gas flow conduit, the gas flow conduit having an apertured zone within the housing wherein apertures extend through the conduit wall, the shape of the conduit wall at the apertured zone being so varied that gas flows through the apertures into or out of the housing the flow inhibiting the development of whistle noises.

Specifically, the invention consists of a muffler having a main gas flow conduit and a surrounding housing defining a muffler space between the main gas flow conduit and the housing, an apertured zone extending along part at least of said conduit wall within the muffler housing wherein apertures through the conduit wall provide gas flow passages between the space within the conduit and the muffler space, the shape of the conduit wall so varying in the apertured zone that when gas flows through said conduit, some of said gas also flows from the conduit space into the muffler space through some of said apertures, and from the muffler space back into the conduit space through others of said apertures.

DESCRIPTION OF THE PREFERRED EMBODIMENT

Several embodiments of the invention are described hereunder in some detail with reference to and are illustrated in the accompanying drawings in which.

Figure 3:
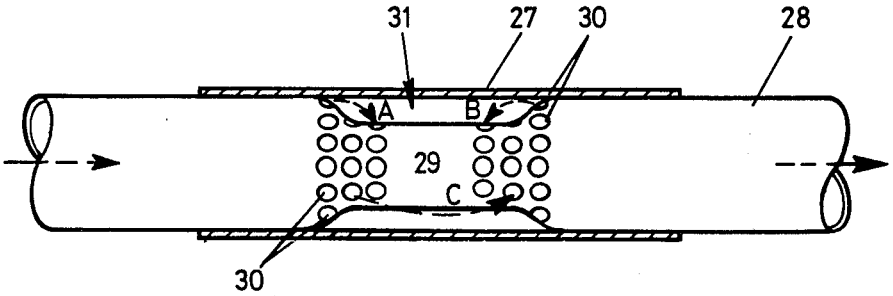
Figure 4:
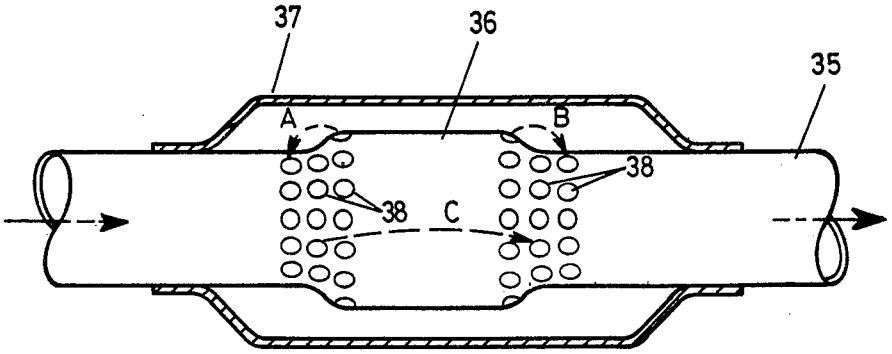
Figure 5:
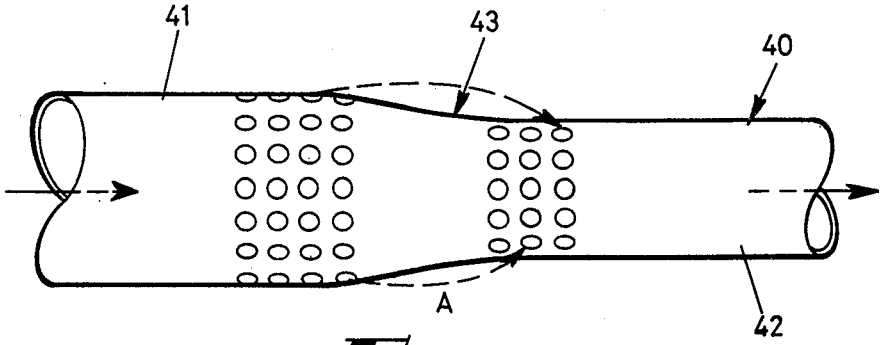
Figure 6:
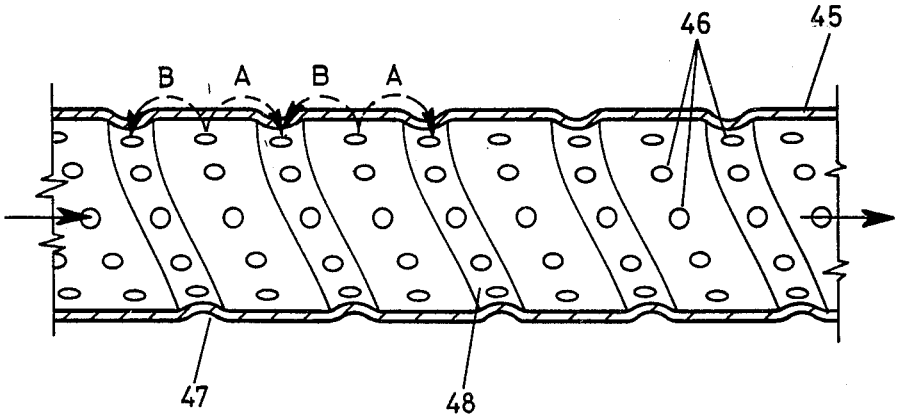

FIG. 3 shows an alternative arrangement wherein the muffler housing is itself a sleeve the inner wall surface or which is contiguous with the outer wall surface of the muffler conduit, FIG. 4 shows a third embodiment wherein the muffler conduit is expanded within a housing, FIG. 5 shows a fourth embodiment wherein the muffler conduit varies in cross-sectional area, and FIG. 6 shows a fifth embodiment wherein the muffler conduit has a constant cross-sectional area but varies in shape alone.

Figure 1:
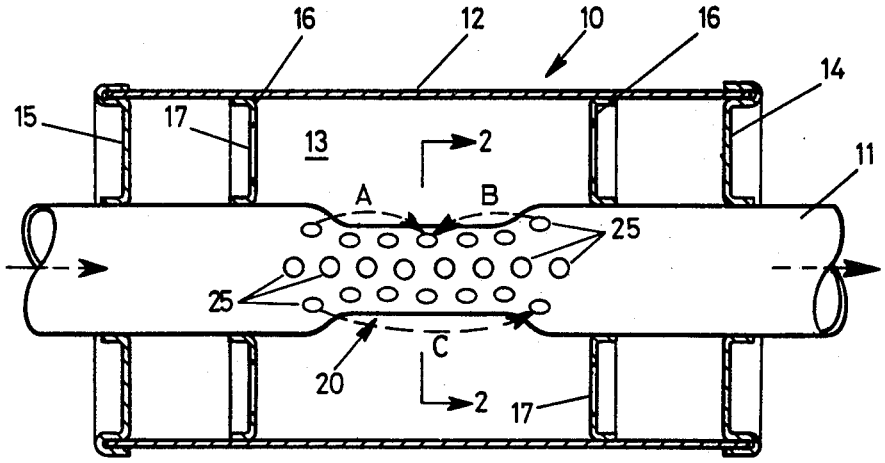
FIG. 1 is a longitudinal section through a muffler of the Helmholtz resonator type wherein the muffler conduit is a cross-sectional area, which varies within a muffler housing.
Figure 2:
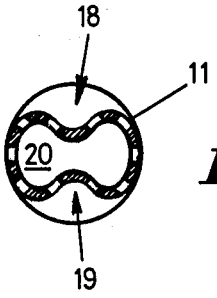
FIG. 2 is a cross-section taken on line 2—2 of FIG. 1.

Referring first to the embodiment of FIGS. 1 and 2, a muffler 10 is provided with a main gas flow conduit 11 and a housing 12 defining a muffler space 13 surrounding the main gas flow conduit 11. The housing 12 includes end plates 14 and 15, and stiffeners 16 which themselves contain large apertures 17, thereby, with the conduit 11, defining a Helmholtz resonator.

As shown in FIG. 2, the wall of the main gas flow conduit 11 is deformed to a "figure 8" shape by having two depressions 18 and 19 opposite one another, and this formation enables the tube to be inserted through openings, for example in stiffeners 16 and 17 or the end plates 14 and 15. In this embodiment, not only is the shape varied, but there is a consequential variation in the cross-sectional area, and at the locality of the section line 2—2, the flow area through the conduit 11 is reduced, thereby forming a throat 20.

Both upstream and downstream of the throat 20, and at the locality of the throat 20, the wall of the conduit has a plurality of apertures 25 therein, and these allow gas flows A, B and C through the apertures 25 and through the muffler space 13.

Within the conduit 11, there is a variation of static or wall pressure and this pressure is lower at the throat than at either of the upstream or downstream ends, because of the higher velocity of flow through the throat. The flow A will occur because of the difference in wall pressure, regardless of whether there is any difference in stagnation pressure upstream and downstream of the throat 20, that is, regardless of whether there is any back pressure in the main flow. The flow B will at most be nearly the same as the flow A in the event of zero stagnation pressure difference, that is, in the event of zero back pressure for the main flow. However, for decreasing amounts of pressure recovery for the main flow beyond the throat 20, the flow B eventually reduces to zero. However, with this form of variation in section, some back pressure is essentially developed, and the flow C is due to this back pressure or stagnation pressure upstream and downstream of the throat. The apertures 25 of course give gas flow access to the Helmholtz resonator defined by the muffler housing 12, and this access is provided without any whistling because of the existence of the flows A, B and C. In the absence of area variation in the main conduit 11, flows A, B and C do not exist and whistles may occur through the phenomenon of edge tones.

In the embodiment of FIG. 3, the housing is designated 27 and is merely a sleeve which passes over a portion of the main flow conduit 28, the main flow conduit 28 having a deformed reduced diameter portion 29 which constitutes a throat. The shape of the deformed portion 29 is not critical to the invention and the throat may be circular, or for example, as shown in FIG. 2. In this embodiment, the apertures 30 are upstream and downstream of the throat 29, and the flows A, B and C exist to some degree within the muffler space 31.

The embodiment of FIG. 4 is similar to that of FIG. 3 as far as the flows A, B and C are concerned, excepting that instead of having a throat 29, the main flow conduit 35 has an expanded portion 36 within the muffler housing 37, and the ends of the expanded portion 36 as well as the portion 36 itself contain apertures 38 through which the flows A, B and C, occur. It will be noted that the flows A and B are in opposite directions from the flows which occur in the FIG. 3 embodiment. In the case of the flow in FIG. 4 the highest wall pressure is at B in the expanded portion 36.

In the embodiment of FIG. 5 (which illustrates only the main flow of conduit 40, since the shape of the muffler housing is inconsequential to this invention), the main flow conduit 40 at its upstream end 41 is larger than at its downstream end 42, but the two portions are interconnected by a converging wall portion 43, the angular slope of which is not critical and may vary over a large range. The only flow in this case is a flow A, the flow being caused by the difference in wall pressure caused by the increase in velocity of gases as they enter the downstream end 42.

In all the above embodiments, the shape of the conduit wall varies in such a way as to vary the cross-sectional area. However, this is not necessary, and in the embodiment of FIG. 6 the cross-sectional area remains constant. However, the main flow conduit 45 (again illustrated without the muffler housing) is provided with apertures 46 throughout its length, and is provided with a spiral groove 47 which forms an inwardly directed helical lobe 48, such that the cross-sectional shape continuously varies but the area does not. The gas flow will be faster over the lobes of the spiral, and this will cause a static pressure drop which will cause A and B flows as shown, but the amount of stagnation pressure drop can be small and the use of this type of main flow conduit will not result in high back pressure and the C type flow will not occur to a great extent.

With this invention, the area variation of the conduit shape may be such that a large decrease of stagnation pressure (that is, a large amount of back pressure in the main flow) is not essential to cause a significant average gas flow through the apertures and the structure dimensions can be such that whistling does not occur. With some alternative designs, whistling occurs through the edge-tone phenomenon.

I claim:

1. A muffler comprising a housing having end plates, stiffeners between the end plates, said stiffeners containing apertures which extend therethrough, a generally circular section conduit extending through said housing and being supported by said stiffeners and said end plates, said housing and conduit defining therebetween a muffler space, an apertured zone extending along part of said conduit between said stiffeners wherein apertures through the conduit wall provide gas flow passages between the space within the conduit and the muffler space, the apertured zone having depressions in the conduit wall which vary its shape from a circular to a non-circular shape which comprises a throat, the dimensions being such that, when gas flows through said conduit, there is a first gas flow from the upstream end of the apertured zone into the muffler space and back into the throat of the conduit, a second gas flow from the downstream end of the apertured zone into the muffler space and back into the throat of the conduit, and a third gas flow from the upstream end of the apertured zone through the muffler space and back into the conduit through some of the apertures which are in the downstream end of the apertured zone.

* * * * *